US007100475B1

(12) United States Patent
Rufolo, Jr.

(10) Patent No.: US 7,100,475 B1
(45) Date of Patent: Sep. 5, 2006

(54) NAIL HOLDER

(76) Inventor: Joseph Rufolo, Jr., 82 King St., Clark, NJ (US) 07066

( * ) Notice: Subject to any disclaimer, the term of this patent is extended or adjusted under 35 U.S.C. 154(b) by 103 days.

(21) Appl. No.: 10/896,141

(22) Filed: Jul. 22, 2004

(51) Int. Cl.
*B25C 3/00* (2006.01)

(52) U.S. Cl. ..... 81/44

(58) Field of Classification Search ..... 81/44
See application file for complete search history.

(56) References Cited

U.S. PATENT DOCUMENTS

| | | | | |
|---|---|---|---|---|
| 1,426,249 | A | 8/1922 | Bochonok | |
| 1,688,445 | A | 10/1928 | Williams | |
| 2,076,134 | A * | 4/1937 | Ross | 81/44 |
| 2,648,066 | A * | 8/1953 | Ingraham | 81/44 |
| 3,060,442 | A | 10/1962 | Tomek | 1/49.8 |
| 4,079,764 | A | 3/1978 | Hayes | 145/46 |
| 4,403,725 | A | 9/1983 | Lawrence | 227/147 |
| 4,422,489 | A | 12/1983 | Ross | 145/46 |
| 4,667,747 | A | 5/1987 | Falls et al. | 173/90 |
| 4,784,025 | A | 11/1988 | Peck | 81/44 |
| 4,829,855 | A | 5/1989 | Martinez | 81/44 |
| 4,843,923 | A | 7/1989 | Voss | 81/44 |
| 4,967,623 | A | 11/1990 | Jackson | 81/44 |
| D324,983 | S | 3/1992 | Sherburne et al. | D8/71 |
| 5,526,723 | A * | 6/1996 | Sormunen et al. | 81/487 |
| 5,933,894 | A | 8/1999 | Bates | 7/164 |
| 6,352,009 | B1 * | 3/2002 | Gaidjiergis | 81/44 |
| 6,925,909 | B1 * | 8/2005 | Crosby et al. | 81/44 |
| 2002/0148479 | A1 | 10/2002 | Willis | 132/75.3 |
| 2005/0166713 | A1 * | 8/2005 | Lloyd | 81/44 |

* cited by examiner

*Primary Examiner*—David B. Thomas
(74) *Attorney, Agent, or Firm*—Thomas L. Adams

(57) ABSTRACT

A nail holder includes a handle having a working head with a cantilever that is bifurcated and sized to receive a nail. The nail holder also includes a magnetic element mounted at the working head.

23 Claims, 5 Drawing Sheets

NAIL HOLDER

BACKGROUND OF THE INVENTION

1. Field of the Invention

The present invention relates to nail holders, and in particular to holders including a magnetic device at a bifurcated distal end.

2. Description of Related Art

Holding a nail with a holding device instead of by hand makes visually locating the nail tip easier and reduces the risk of injury during hammering. Nevertheless, the known devices have less than desirable visibility and have not been well arranged to facilitate capturing the nail and holding it in a desired orientation at a work surface.

In FIG. 2 of U.S. Pat. No. 4,967,623 magnetic head 7 has a slot for holding a nail. FIGS. 3 and 5 show a hand tool with a magnetic head 13 having a slot for holding a nail. In the embodiment of FIG. 6 the magnetic head is replaced with a V-shaped magnetic plate.

In U.S. Pat. No. 3,060,442 both ends of a flexible nail holder are bifurcated and have recesses 20, 21, 32, and 33 for holding a nail.

U.S. Design Pat. No. 324,983 shows a nailing tool with a bifurcated end having a beveled underside.

In FIG. 2 of U.S. Pat. No. 4,667,747 a magnetic head 14 mounted on handle 18 has a V-shaped notch for holding a nail.

In U.S. Pat. No. 4,829,855 a tweezer-like device can be opened with a pushbutton. The tips of the tweezer jaws are magnetized to hold a nail.

In U.S. Pat. No. 4,784,025 a handle supports a metal block having an angled slot 31 with a ball detent 30 for holding a nail as it is being driven through corrugated sheet metal. This device is non-magnetic.

In U.S. Pat. No. 1,688,445 a pair of curved, hinged jaws that grip a nail has a curved underside designed to fit over corrugations. This device is not magnetic.

In U.S. Pat. No. 1,426,249 a non-magnetic hand tool has a bifurcated tip with recesses 6 designed to hold a nail.

In U.S. Pat. No. 4,843,923 a hand tool has two bifurcated, non-magnetic ends that can hold nails, including magnetic fasteners. Unless bent as shown in FIG. 5 the underside of the arms are flat.

In U.S. Pat. No. 4,422,489 a handle 60 supports a non-magnetic rubber blade 20 having a flat underside and a number of notches for holding a nail.

In U.S. Pat. No. 4,079,764 a non-magnetic hand tool has five notches on one end and a single notch at the opposite end to hold a nail. These two ends appear to be slightly curved. See also U.S. Pat. No. 5,933,894.

In U.S. Patent Application Publication No. 2002/0148479 a fingernail lifter has a tapered tip with a recessed underside. A thin blade is supported on this tip.

In U.S. Pat. No. 4,403,725 a sleeve has a distal end fitted with hinged jaws that can hold a nail axially. The sleeve also contains a striker rod that can be struck to drive the nail.

SUMMARY OF THE INVENTION

In accordance with the illustrative embodiments demonstrating features and advantages of the present invention, there is provided a nail holder including a handle having a working head with a cantilever that is bifurcated and sized to receive a nail. The nail holder also includes a magnetic element mounted at the working head.

By employing the foregoing principles an improved nail holder is achieved. In one preferred embodiment the nail holder has an ergonomically curved handle with a distal working head having an upper bifurcated cantilever and a lower embedded magnet. Preferably, the magnet is spaced from the bifurcated cantilever to capture the nail and establish a desired alignment when the nail is embraced by the bifurcation. Also, this preferred nail holder has at its working head a flat bottom that can be flatly rested on a work surface to establish an accurately defined nail orientation. A rounded corner next to the flat bottom can be used to tilt the nail when the user wishes to establish a different angular orientation.

In another preferred embodiment, the working head can be pivotally attached to the handle so the user can adjust the angle of the working head and use the handle at an angular orientation satisfying the user's preferences. In such embodiments tilting of the working head can be avoided by extending its flat bottom fore and aft so the flat bottom lies flatly against a work surface when the user presses down.

A pivoting joint between the handle and working head can be accomplished with a simple pin or with a more elaborate mechanism that will hold an angular orientation. For example, the pivoting pin can be tapered so that its larger portion can be thrust into a split bushing to expand the bushing and prevent further rotation at the pivot joint. Alternatively, a grooved hub can support a reciprocating nub that is outwardly urged by a resilient elastomeric slab. The hub can fit into a complementary bearing hole so the nub can "click" into a number of angularly spaced detent notches.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying drawings, wherein.

DETAILED DESCRIPTION OF THE PREFERRED EMBODIMENTS

Figure 1:
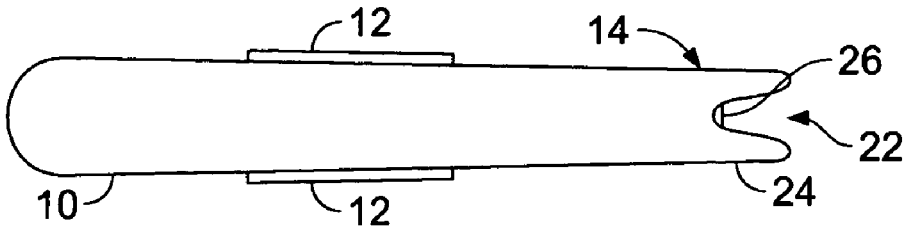
FIG. 1 is a top view of the nail holder in accordance with principles of the present invention.
Figure 2:
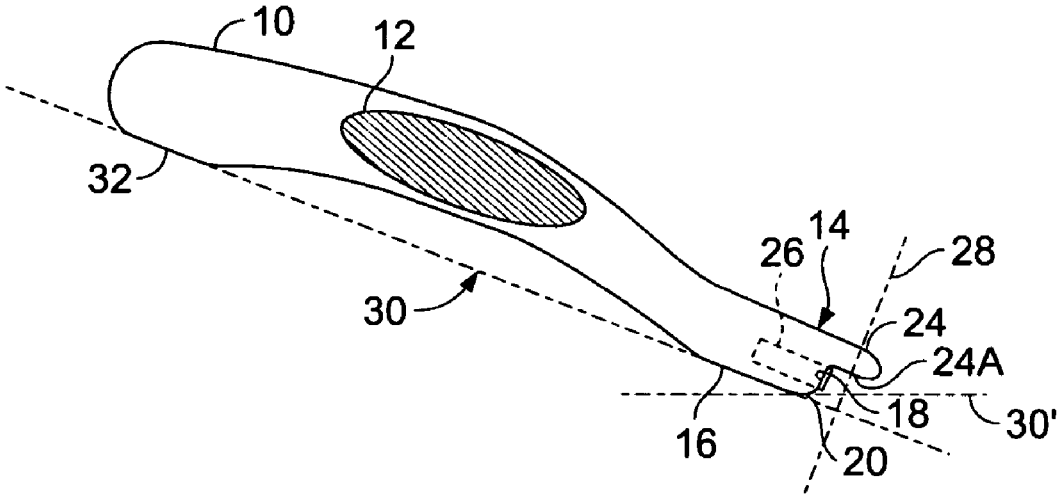
FIG. 2 is a side view of the nail holder of FIG. 1.

Referring to FIGS. 1 and 2 an example of a nail holder is shown with an arched, ergonomically shaped handle 10 that has a slight taper from the proximal to distal ends. In this embodiment the overall length of the nail holder is 6 inches, and preferably this dimension is 4 to 10 inches. A knurled pair of oval, external finger pads 12 are embossed near the center of the right and left sides of handle 10. The distal end of handle 10 is formed into a working head 14 having a flat bottom 16 that meets the transverse distal face 18 in a rounded corner 20.

Working head 14 supports an integral cantilever 24 having a V-shaped bifurcation 22 with a rounded root. The underside 24A of cantilever 24 overhangs and is approximately perpendicular to the distal face 18 of working head 14.

Embedded in working head 14 is a magnetic element 26 whose distal pole extends slightly beyond distal face 18. Element 26 is a permanent magnet strong enough to securely hold a nail (shown hereinafter) in a position parallel to nail axis 28 and in the embrace of bifurcation 22 of cantilever 24. Magnet 26 is positioned at a lower elevation than cantilever 24 so that a nail near nail axis 28 will be seized by magnet 26 and fixed at two points: the center of magnet 26 and the root of bifurcation 22. Thus the nail will self-align to a position parallel to nail axis 28. In this embodiment the self-aligning nail axis 28 will be perpendicular to flat bottom 16 and cantilever 24.

Often, the flat bottom 16 of handle 10 will be used as a surface engaging face that is placed flat against a work surface 30 so that the nail will be perpendicular to surface 30. In this embodiment handle 10 also has a flat 32 that is coplanar with flat bottom 16 so that surfaces 16 and 32 can both be placed flat against work surface 30 to ensure a fixed and definite orientation of nail axis 28, without the user needing to make a visual assessment as to whether the nail axis is in fact perpendicular. In other instances, handle 10 will be lifted so that flat 32 is elevated and rounded corner 20 rests on work surface 30' so that the nail axis 28 is slanted.

It will be appreciated that in other embodiments the nail axis 28 can be different and can be manufactured with the axis slanted relative to flat bottom 16 so that when rounded corner 20 is placed on work surface 30' as shown in FIG. 2 the nail axis 28 can be made perpendicular to work surface 30'. With this modified nail axis, if surfaces 16 and 32 are placed flat against a work surface then the nail axis will be slanted.

In some embodiments, rounded corner 20 can be replaced with one or more flat facets (not shown) so that the user can place one of the facets flat against the work surface and be assured that the nail axis will have a predetermined orientation (e.g., perpendicular or ±15° from perpendicular). In still other embodiments, bottom 16 can be cylindrical with its axis either parallel or transverse to the length of handle 10. Alternatively, instead of being cylindrical, in some embodiments bottom 16 can have a more complex shape and may have a convex ovoid shape that curves longitudinally and transversely.

Figure 3:
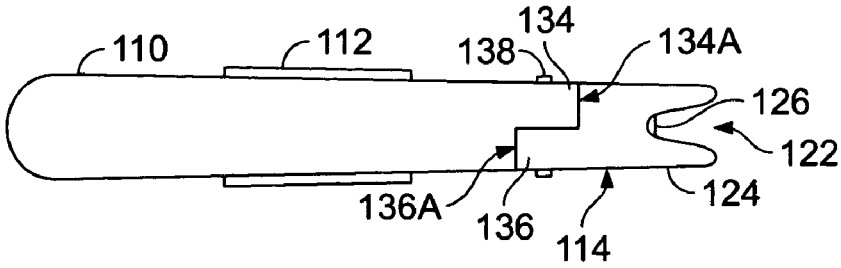
FIG. 3 is a top view of a jointed nail holder that is an alternate to that of FIG. 1.
Figure 4:
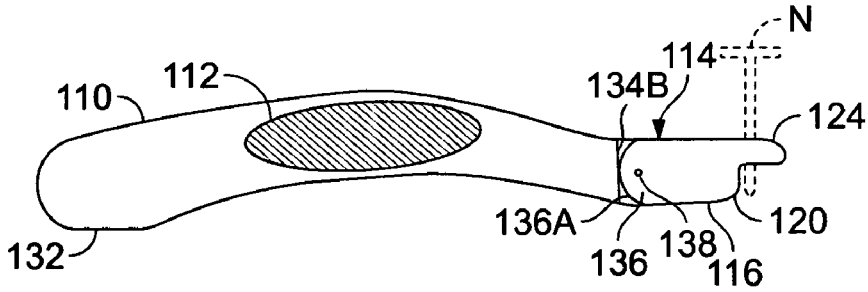
FIG. 4 is a side view of the nail holder of FIG. 3.
Figure 5:
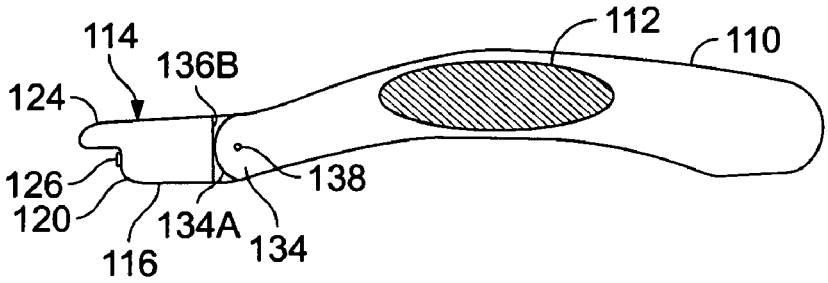
FIG. 5 is a side view of the nail holder of FIG. 3 on the side opposite to that illustrated in FIG. 4.

Referring to FIGS. 3–5, the illustrated nail holder is similar to that shown in FIGS. 1–2 and therefore corresponding components will have the same reference numerals but increased by 100. The main difference with the embodiment of FIGS. 3–5 is that working head 114 is pivotally attached to handle 110. Specifically, components 110 and 114 are shown with tongues 134 and 136, respectively, that form a half lap joint rotatably connected by a pin 138 acting as a pivot axis. In this embodiment, the proximal end 136A of tongue 136 is rounded and faces a flat ledge 134B at the base of tongue 134. The distal end 134A of tongue 134 is rounded and faces a flat ledge 136B at the base of tongue 136.

An advantage of this rotatable joint is that the angle of elevation of handle 110 can be adjusted relative to flat bottom 116. Accordingly, the user's hand can be placed at a comfortable orientation while still allowing head 114 to keep the nail N at a favored orientation. Once again, nail N is self-aligning in that magnet 126 keeps the nail in the embrace of bifurcation 122 so that a preferred nail orientation is assured. Note that with this embodiment the user can set the angle of head 114 so that with handle 110 at a comfortable orientation either (a) bottom 116 is placed flat against the work surface, or (b) rounded corner 128 is placed tangentially against the work surface.

Figure 6:
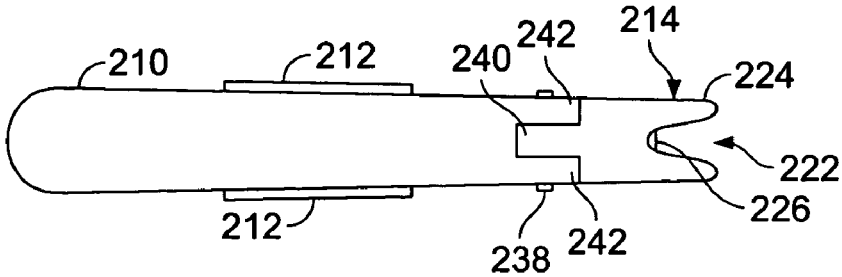
FIG. 6 is a top view of a nail holder similar to that of FIG. 3 but with an alternate pivot joint.

Referring to FIG. 6, the illustrated nail holder is similar to the embodiment of FIGS. 1–2 and therefore corresponding components will have the same reference numerals but increased by 200. The main difference with this embodiment is that the working head 214 is pivotally attached to handle 210. Instead of the previously mentioned lap joint, this embodiment has a tongue and slot joint, with tongue 240 extending rearwardly from the proximal end of working head 214. Tongue 240 fits within a slot formed between a pair of parallel blades 242 extending from the distal end of handle 210. Head 214 is pivotally connected to handle 210 by means of a pin 238 forming a pivot axis.

An issue with the embodiment of FIGS. 3–5 (as well as the embodiment of FIG. 6) is that when the user presses down on working head 114 (214) the downward force is applied to the proximal end of head 114 (214), which does not necessarily apply balanced forces to both ends of flat bottom 116 and avoid the possibility of tilting.

Figure 7:
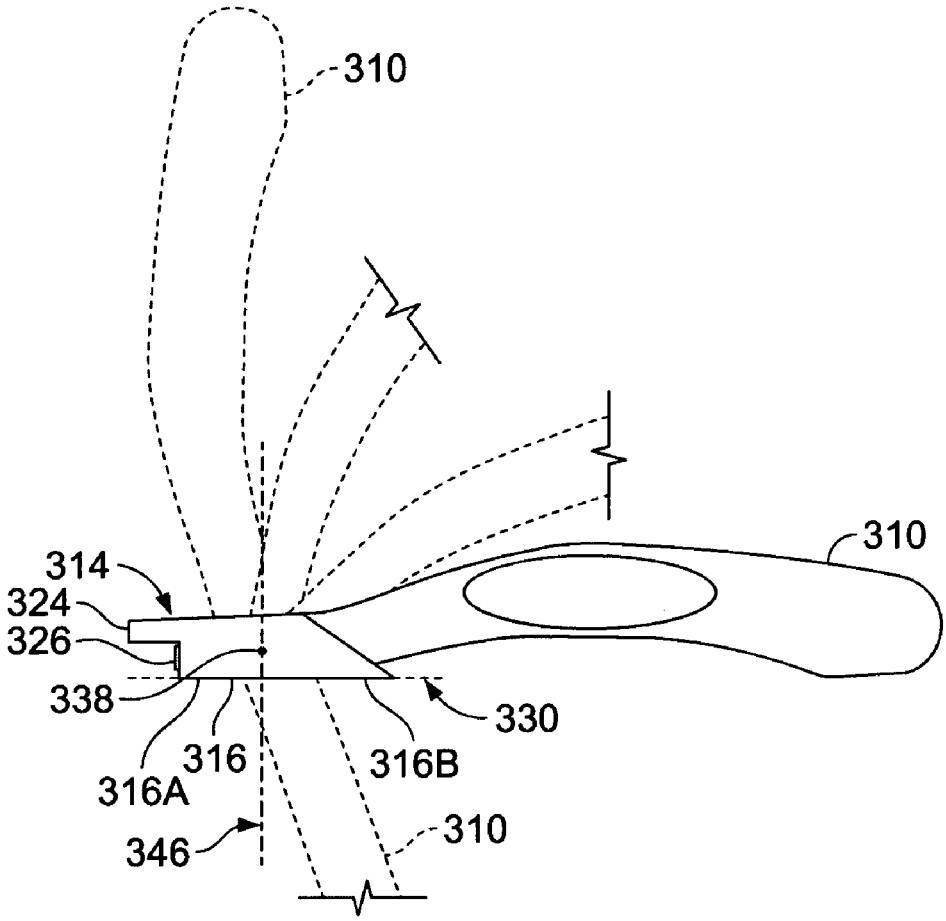
FIG. 7 is a side view of a nail holder that is an alternate to that of FIGS. 1, 3 and 6 and showing in phantom a plurality of detent positions.

The embodiment of FIG. 7 addresses this issue by placing the pivot axis 338 in a plane 346 that (a) is perpendicular to flat bottom 316, and (b) centrally intersects bottom 316 into a forward section 316A and an aft section 316B. Accordingly, downward pressure applied through the pivot axis 338 tends to be more evenly distributed along flat bottom 316.

Moreover, the user need not be overly concerned about whether the bottom 316 will flatly engage the work surface 330. If the handle 310 were held at an unusual angle with the bottom 316 initially tilted, downward pressure through pivot axis 338 will tend to rotate head 314 so that it flatly engages the work surface 330. Since this embodiment anticipates bottom 316 being usually flat against work surface 330, the corners of forward section 316A and aft section 316B are not rounded.

Also, FIG. 7 clearly shows how the angular orientation of handle 310 can change, with four optional angular orientations being shown in phantom. This Figure also shows that the handle 310 can be rotated below the head 314 to accommodate situations where a nail is being held at an outside corner and the user wishes to hold the handle at a location below the tip of the nail. Preferably, handle 310 can be rotated ±90°, although in some embodiments a different angular range will be employed. The joint between handle 310 and head 314 can either be a half lap joint in accordance with FIG. 3 or a tongue and slot joint in accordance with FIG. 6.

Figure 8:
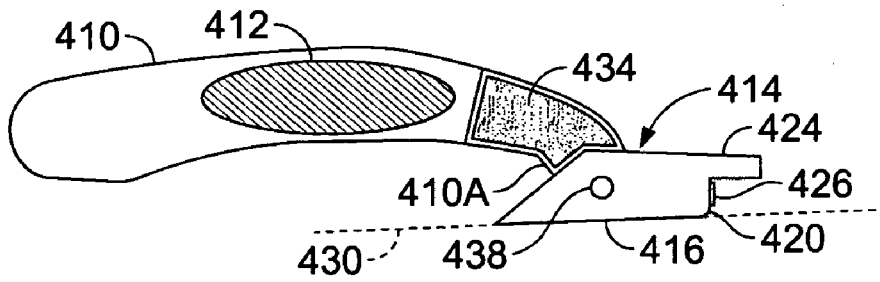
FIG. 8 is a side view of a nail holder of that is an alternate to those previously shown.

Referring to FIG. 8, the illustrated nail holder is similar to the embodiment of FIG. 7 and therefore corresponding components will have the same reference numerals but increased by 100. Working head 414 is similar to head 314 of FIG. 7, except this illustrated head 414 has a rounded corner 420. Also, handle 410 has a similar shape but has a downward jog 410A. Accordingly, if the handle 410 is held in a position substantially parallel to work surface 430 there will be an underlying clearance that allows the user's fingers to wrap around the handle. The joint between handle 410 and head 414 can either be a half lap joint in accordance with FIG. 3 or a tongue and slot joint in accordance with FIG. 6.

Figure 9A:
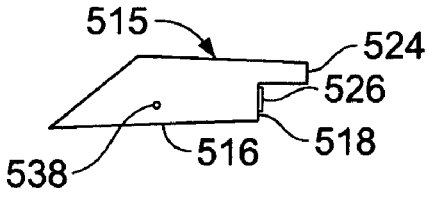
FIG. 9A is a side view of a working head that is an alternate to those mentioned above.
Figure 9B:
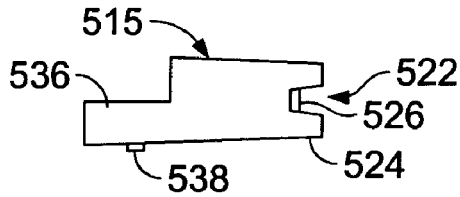
FIG. 9B is a top view of the working head of FIG. 9A.

Referring to FIGS. 9A and 9B, the illustrated working head 514 is similar to that shown in FIG. 7 and corresponding components have the same reference numerals but increased by 200. In this embodiment an integral, proximal tongue 536 projecting from the rear of head 514 can form a pivoting lap joint similar to that shown in FIG. 3. The corner between distal face 518 and flat bottom 516 is sharp and is not rounded.

Figure 10A:
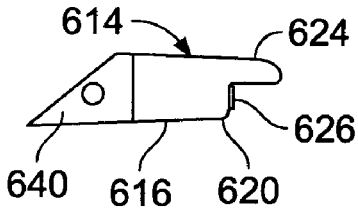
FIG. 10A is a side view of a working head that is an alternate to those mentioned above.
Figure 10B:
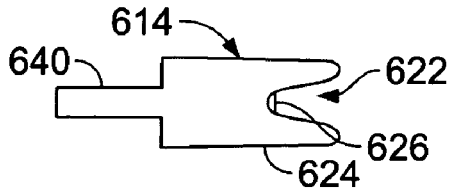
FIG. 10B is a top view of the working head of FIG. 10A.

Referring to FIGS. 10A and 10B, working head 614 is similar to that shown in FIGS. 9A and 9B and corresponding components have the same reference numerals but increased by 100. In this embodiment an integral, proximal tongue 640 projecting from the rear of head 614 can form a pivoting tongue and slot joint similar to that shown in FIG. 6. The distal edge of flat bottom 616 is formed into a rounded corner 620.

The head of FIGS. 9A and 9B as well as the head of FIGS. 10A and 10B can be used with any of the handles described herein.

Figure 11:
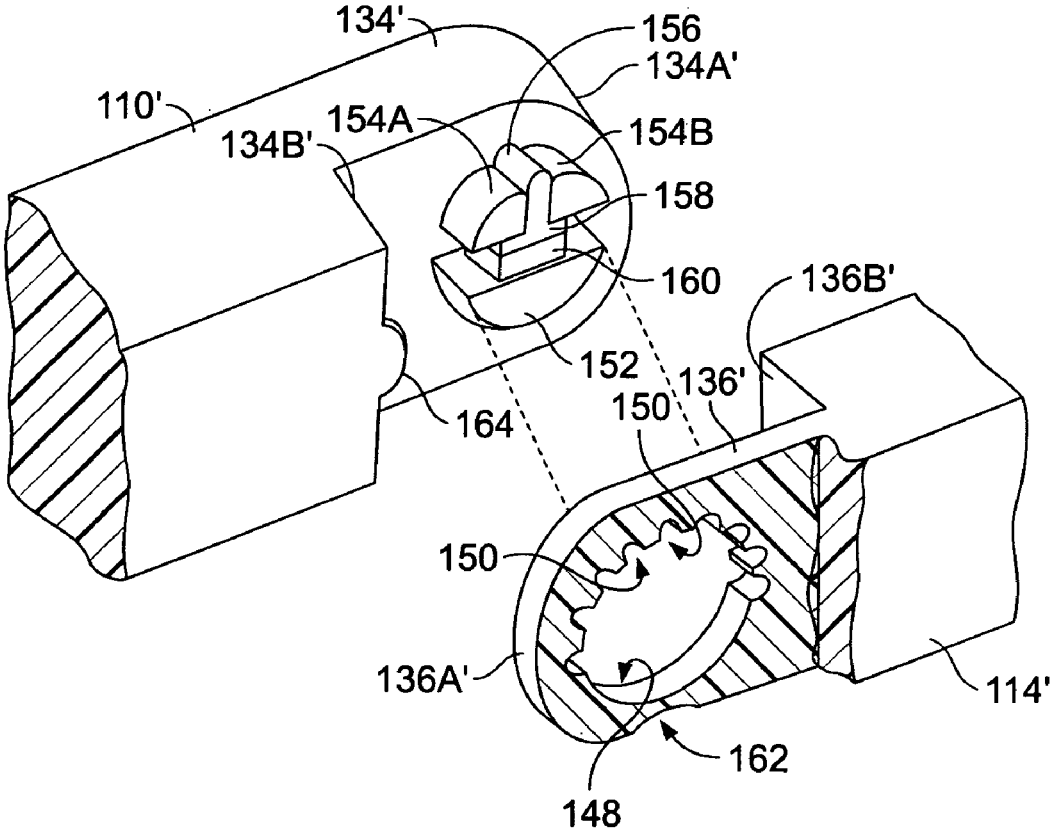
FIG. 11 is a detailed, fragmentary, exploded view of a modified joint for the nail holder of FIGS. 3–5.

Referring to FIG. 11, the nail holder of FIGS. 3–5 has a modified joint, and corresponding components have the same reference numerals but marked with a prime (').  In particular, the tongue 136' of head 114' has, for illustrative purposes, an outside portion broken away to show the outline of a blind hole 148. Hole 148 is essentially cylindrical except for nine equiangularly spaced, axial notches 150.

A slotted hub sized to fit inside hole 148 is formed from a semicylindrical hub sector 152 and two frustro-cylindrical hub quadrants 154A and 154B. A biased nub 156 slidably mounted between hub quadrants 154A and 154B has a flange 158 that prevents the nub from radially sliding out of the hub. A small resilient elastomeric slab 160 is mounted between flange 158 and hub sector 152. Slab 160 acts as a compliant member that can compress and allow depression of the distal end of nub 156 to a position flush with the curved perimeter of hub quadrants 154A and 154B. When thus depressed, the hub 152/154A/154B can slide into the hole 148, provided the head 114' is in its limit position so that notch 162 in tongue 136A' aligns with and clears locking tab 164 on ledge 134B'.

Once mounted in this fashion, head 114' can be rotated from its limit position so that the unnotched region 136A' of tongue 136 will rotate behind tab 164 to be captured thereby. The head 114' can rotate as nub 156 falls into successive ones of the notches 150. When nub 156 aligns with one of the notches 150, compliant member 160 extends the nub 156 fully into the notch. The positions where nub 156 lands into the notches 150 are effectively detent positions. The range of notches 150 correspond to head 114' rotating ±90°, with the angular increment between detent positions being 22.5°, although other angular increments and ranges are contemplated.

Figure 12:
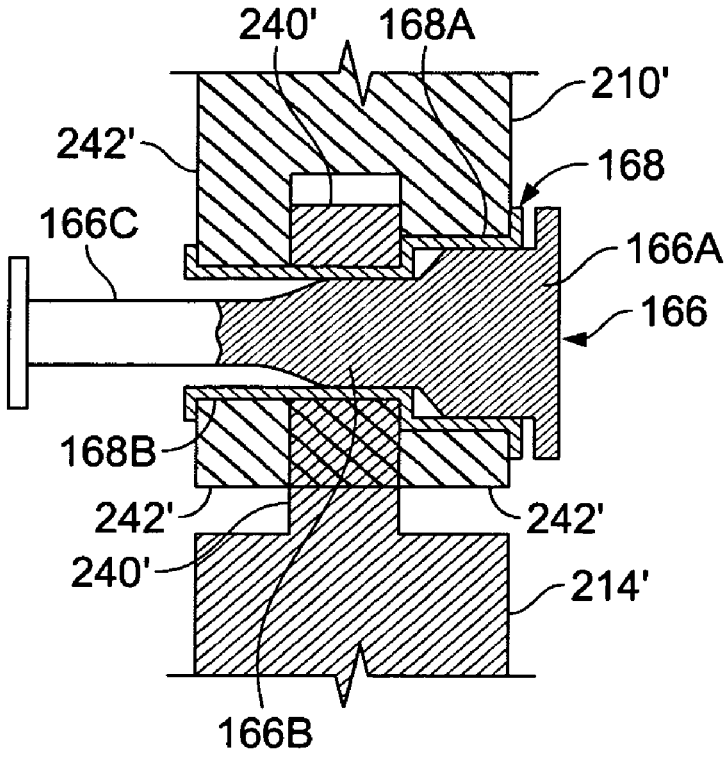
FIG. 12 is a cross-sectional view of a modified joint for the nail holder of FIG. 6.
Figure 13:
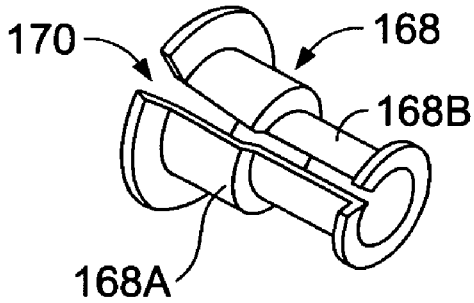
FIG. 13 is perspective view of the bushing of FIG. 12.

Referring to FIGS. 12 and 13, the nail holder of FIG. 6 has a modified joint, and corresponding components have the same reference numerals but marked with a prime (').  In particular, pin 166 is mounted in the coaxially aligned holes in blades 242' and tongue 240'. The size of the hole in tongue 240' is the same size as the hole in only one of the blades 242', the other blade hole (shown as the right one in FIG. 12) is larger. Pin 166 is encompassed by a split bushing 168 having a flanged sleeve 168A integrally joined with a smaller flanged sleeve 168B.

Pin 166 is flanged on both ends and is considered tapered in that its cylindrical midsection 166B has a larger diameter than its cylindrical end section 166C. The transition between sections 166B and 166C is frustoconical, but in some instances the transition may be a perpendicular step (especially where the bushing 168 has a frustoconical transition). The cylindrical end section 166A of pin 166 has a larger diameter than section 166B and the transition between sections 166A and 166B is frustoconical.

When pin 166 is pushed to the left as shown in FIG. 12, split bushing 168 expands and presses tightly in the holes in blades 242' and tongue 240'. Accordingly, head 214' cannot readily rotate relative to handle 210'. If pin 166 is pushed to the right, then midsection 166B displaces end section 166A from inside bushing section 168A. Consequently, bushing 168 can relax so that head 214' can readily rotate relative to handle 210'.

To facilitate an understanding of the principles associated with the foregoing embodiments, the operation of the nail holder of FIGS. 1 and 2 will be briefly described. The handle 10 of the holder can be grasped with the fingers pressed against pads 12. With the surfaces 16 and 32 held against work surface 30, a nail will be held perpendicularly along nail axis 28. Specifically, the user may bring a nail next to magnet 26 either manually or by bringing head 14 near a nail. Magnet 26 is strong enough to quickly capture a nail and hold it in the embrace of bifurcation 22 of cantilever 24.

The clearance under cantilever 24 increases the visibility of the work surface 30 (or 30'). This enhanced visibility allows the user to locate the tip of a nail accurately on the work surface 30. In the present embodiment the spacing between the underside 24A of cantilever 24 and work surface 30 is about ⅛ inch, and preferably this dimension will be about 1/16 to 3/16 inch.

Also, the cantilever 24 is high enough to accurately maintain the orientation of a nail captured by magnet 26. If the nail is considered a lever with its fulcrum centered at the magnet 26, the accuracy of the angular orientation of this lever (relative to the longitudinal axis of handle 10 or of magnet 26) is greater when the position of the lever is fixed further out on the lever arm. In the present embodiment, the distance between magnet 26 and underside 24A of cantilever 24 is about ⅛ inch, and preferably this dimension will be about 1/16 to 3/16 inch. Also, the width of the bifurcation 22 ought to be narrow enough to accurately align a small nail, but wide enough to accommodate larger nails. In the present embodiment the width of the bifurcation about halfway in is about ⅛ inch, and preferably this dimension will be about 1/16 to 3/16 inch. Also in the present embodiment, bifurcation 22 is tapered with the opposite sides forming an angle of about 20°, and preferably this angle will be between 10° and 30°.

Some users may prefer to elevate handle 10 so that rounded corner 20 rests on surface 30' as shown in FIG. 2. This may not only be more comfortable for some users, but will also allow the user's fingers to wrap around handle 10, because there is clearance under the handle (unlike the situation where surfaces 16 and 32 are resting on work surface 30). In addition, the user has control of the angular orientation of axis 28, being able to make that angle steeper or shallower as desired. Also, a non-perpendicular nail orientation may be important where the user wishes the nail to slant down so that a wall hanging tends to fall closer to the wall.

Once the tip of the a nail is accurately located on the work surface 30 (or 30') and the nail axis 28 is established, the user may drive the nail with a hammer (not shown) without risking personal injury.

The use of the nail holder of FIGS. 3–5 is similar, although some embodiments may employ the detent or holding mechanism shown in FIG. 11. In such cases, the head 114' can be rotated relative to handle 110'. When progressing between notches 150, nub 156 will be depressed so that compliant member 160 will be compressed. Such rotation may end with nub 156 falling into one of the notches 150 where compliant member 160 will drive the nub outwardly and fully into the corresponding notch 156. Accordingly, the angular orientation between handle 110' and head 114' will be maintained so that the nail holder may be used in the same manner just described in connection with the embodiment of FIG. 1.

In the alternate embodiment of FIG. 12, the user may be holding the handle 214' and decide to change the angular orientation. In that case, the user's finger can press the left end of pin 166 bringing the thinner section 166C into the middle of tongue 240' and freeing the pivot joint. Once the desired angular orientation is established, the user can press the right end of pin 166 with a finger to reseat the thicker pin section 166B inside bushing section 168B thereby expanding the bushing 168 and locking tongue 240' relative to blades 242'.

The use of the nail holder of FIG. 8 is similar, although the jog 410A provides clearance under handle 410 and allows the user's fingers to wrap around the handle, while keeping it relatively parallel. Whether handle 410 is kept parallel to work surface 430 (or placed in one of the many positions shown in FIG. 7) the user may press head 414 down through pivot 438 to bring bottom 416 flatly against work surface 430. Because there is a section of flat bottom 416 fore and aft of pivot pin 438, head 414 will not tend to tilt and will be pressed flatly against work surface 430 thereby ensuring an accurate orientation of the nail axis.

The operation of the other nail holders and working heads will be similar to that previously described, but with the differences and features previously mentioned.

It will be appreciated that various modifications may be implemented with respect to the above described, preferred embodiments. In some embodiments the joint between the handle and working head may be formed with a cylindrical journal that snaps into a split sleeve. In other embodiments the joint can be formed with two opposing disks having radial striations that produce a plurality of detent positions. In some embodiments the clearance under the cantilever can be achieved with a holder having an S-shaped axis so that the cantilever projects upwardly from a curved valley at an acute angle from the work surface, which will allow the user to rotate the handle about the valley and change the nail orientation. In some embodiments the flat bottom of the working head may be a relatively small circular or oval facet surrounded by a domed portion, so that the user can either established a fixed angular orientation with the facet or use the domed portion for another arbitrary angle. Preferably, the handle will be molded plastic although in other embodiments the device may be made of wood, ceramic, metal, composite materials, etc. The dimensions and shapes illustrated and described herein can be varied depending upon the user's hand size, the size of the nails being employed, the desired strength, etc.

Obviously, many modifications and variations of the present invention are possible in light of the above teachings. It is therefore to be understood that within the scope of the appended claims, the invention may be practiced otherwise than as specifically described.

The invention claimed is:

1. A nail holder comprising:

a handle having a working head with a cantilever that is bifurcated and sized to receive a nail, said cantilever having a topside and an underside; and a magnetic element mounted at said working head, said magnetic element being mounted to reside completely below the topside of said cantilever, said working head having (a) a surface engaging face, and (b) below the underside of said cantilever a distal face meeting said surface engaging face at a transition region, so that said nail holder can engage a work surface at either said transition region or said surface engaging face.

2. A nail holder according to claim 1 wherein said magnetic element is mounted at a lower elevation than the underside of said cantilever.

3. A nail holder according to claim 2 wherein said distal face meets said surface engaging face at a rounded corner, so that said nail holder can engage a work surface at either said rounded corner or said surface engaging face.

4. A nail holder according to claim 3 wherein said magnetic element is mounted at least partially in said working head and projects outwardly beyond said distal face.

5. A nail holder according to claim 3 wherein said magnetic element is mounted at least partially in said working head and is spaced from said cantilever an amount sufficient to allow said magnetic element to draw the nail into the embrace of said cantilever and orient the nail substantially perpendicular to said cantilever.

6. A nail holder according to claim 1 wherein said working head has a flat bottom.

7. A nail holder according to claim 6 wherein said magnetic element holds the nail in the bifurcated cantilever perpendicular to the flat bottom of said working head.

8. A nail holder according to claim 7 wherein said handle has a flat that is coplanar with the flat bottom of said working head.

9. A nail holder according to claim 1 wherein said working head is pivotally attached to said handle to pivot about a pivot axis.

10. A nail holder according to claim 9 wherein said working head has a flat bottom.

11. A nail holder according to claim 10 wherein said magnetic element holds the nail in the bifurcated cantilever perpendicular to the flat bottom of said working head.

12. A nail holder according to claim 10 wherein a plane that contains the pivot axis and is perpendicular to the flat bottom of said working head divides the flat bottom into a forward and aft surface.

13. A nail holder according to claim 9 wherein said working head and said handle pivotally connect through a tongue and slot joint.

14. A nail holder according to claim 9 wherein said working head and handle pivotally connect through a lap joint.

15. A nail holder according to claim 9 wherein said working head and handle pivotally connect through a half lap joint.

16. A nail holder according to claim 9 wherein said working head and said handle pivotally connect to swing through an obtuse angle.

17. A nail holder according to claim 9 wherein said working head and said handle pivotally connect to swing through a plurality of detent positions.

18. A nail holder according to claim 9 comprising:

a biased nub mounted to reciprocate at the juncture between said handle and said working head and engage one of a plurality of notches formed in either one of said handle and said working head.

19. A nail holder according to claim 18 comprising:

a compliant member mounted adjacent to said biased nub for outwardly urging it.

20. A nail holder according to claim 9 comprising:

a tapered pin pivotally connecting said working head and handle; and a split bushing encompassing said tapered pin, said tapered pin being mounted to axially reciprocate and thereby expand and contract said split bushing in order to seize and free, respectively, said working head and handle.

21. A nail holder according to claim 1 wherein said handle is arched.

22. A nail holder according to claim 21 wherein said handle has at least one external finger pad.

23. A nail holder for holding a nail at a work surface, comprising:

a handle having a working head with a topside and a flat bottom, said working head having a bifurcation sized to receive a nail, said working head extending at an angle from said handle to provide finger clearance when said flat bottom flatly engages said work surface; and a magnetic element longitudinally embedded in said working head exclusive of a flat magnet face that is exposed to seize the nail and hold it in the bifurcation next to the magnetic element substantially perpendicular to said flat bottom, said magnetic element being embedded in said working head to reside completely below the topside of said working head.

* * * * *